US010415252B1

(12) United States Patent
Polston

(10) Patent No.: US 10,415,252 B1
(45) Date of Patent: Sep. 17, 2019

(54) ATTIC VENT

(71) Applicant: Ross Manufacturing, LLC, New Braunfels, TX (US)

(72) Inventor: Scott Ross Polston, New Braunfels, TX (US)

(73) Assignee: Ross Manufacturing, LLC, New Braunfels, TX (US)

( * ) Notice: Subject to any disclaimer, the term of this patent is extended or adjusted under 35 U.S.C. 154(b) by 0 days.

(21) Appl. No.: 16/183,205

(22) Filed: Nov. 7, 2018

(51) Int. Cl.
*E04D 13/17* (2006.01)
*F24F 7/04* (2006.01)

(52) U.S. Cl.
CPC ..... *E04D 13/17* (2013.01); *F24F 7/04* (2013.01)

(58) Field of Classification Search
CPC ..... E04D 13/17; F24F 7/04
See application file for complete search history.

(56) References Cited

U.S. PATENT DOCUMENTS 2,628,551 A * 2/1953 Leigh ..... F24F 7/02 454/366
4,386,488 A * 6/1983 Gibbs ..... E04D 13/1407 454/367
6,155,008 A * 12/2000 McKee ..... E04D 13/0325 52/198
6,612,924 B1 * 9/2003 Mantyla ..... E04D 13/17 454/366
6,767,281 B2 7/2004 McKee
D556,314 S * 11/2007 Daniels, II ..... D23/393
7,544,124 B2 6/2009 Polston
7,780,510 B2 8/2010 Polston
8,181,403 B1 * 5/2012 Polston ..... F24F 13/082 52/198
2014/0342658 A1 * 11/2014 Parkinson ..... F24F 7/02 454/367
2016/0040898 A1 * 2/2016 Lipinski ..... F23L 17/04 454/242

FOREIGN PATENT DOCUMENTS

FR 1475051 A * 3/1967 ..... E04D 13/1407

* cited by examiner

*Primary Examiner* — Adriana Figueroa
(74) *Attorney, Agent, or Firm* — Erio Karich; Karich & Associates

(57) ABSTRACT

An attic vent has a base component, a dome-shaped cover, and a mounting mechanism for mounting the dome-shaped cover onto and over the base component. The base component has a mounting plate with a vent opening having a vertical wall surrounding the vent opening and extending upwardly from the mounting plate and to an upper rim. A diverter extension wall extends upwardly from the upper rim on a plane that is orthogonal to the mounting plate, and further an open grill extends upwardly from the upper rim at an inward angle from the diverter extension wall. The dome-shaped cover extends outwardly and downwardly to a bottom edge, while covering the open grill. The mounting mechanism further extends downwardly over the vertical wall and is spaced from the mounting plate.

6 Claims, 4 Drawing Sheets

ATTIC VENT

BACKGROUND OF THE INVENTION

Field of the Invention

This invention relates generally to vents, and more particularly to an attic vent that is constructed of only two components, and which includes an improved baffle element for preventing water leakage during heavy rains, which is integral to the base of the vent.

Description of Related Art

There are various attic vents known in the art for covering a vent opening in a roof for providing ventilation to a home or other structure.

McKee, U.S. Pat. No. 6,767,281, for example, teaches a roof vent that includes a base portion that is mounted on a roof of a structure, a vent structure for allowing venting to the structure, and a cover portion for excluding rain. Another example is shown in Perry et al., U.S. Pat. No. 3,934,383, which teaches another roof vent of generally similar construction.

The state of the art vent is disclosed in Polston, U.S. Pat. No. 7,780,510, which teaches an attic vent that includes a base member adapted to be mounted on a roof, and a cover dome for covering the base member for excluding water. Importantly, the attic vent further includes a third diverter component that is positioned between the base member and the cover dome, and which includes an angled flange that extends across some of the space between the base and the cover for forming a baffle therebetween. The above-described references are hereby incorporated by reference in full.

The prior art teaches attic vents having a three part construction that include a base, a cover, and an angled diverter in between. However, the prior art does not teach an attic vent that includes a two-part construction that includes a base component and a dome-shaped cover, and wherein the base component includes a diverter extension wall that extends upwardly from an upper rim of the base component on a plane that is orthogonal to a mounting plate of the base component. The present invention fulfills these needs and provides further related advantages as described in the following summary.

SUMMARY OF THE INVENTION

The present invention teaches certain benefits in construction and use which give rise to the objectives described below.

The present invention provides an attic vent for diverting water away from a vent opening on a roof. The attic vent includes a base component, a dome-shaped cover, and a mounting mechanism for mounting the dome-shaped cover onto and over the base component. The base component has a mounting plate with a vent opening having a vertical wall surrounding the vent opening and extending upwardly from the mounting plate and to an upper rim. A diverter extension wall extends upwardly from the upper rim on a plane that is orthogonal to the mounting plate, and further an open grill extends upwardly from the upper rim at an inward angle from the diverter extension wall. The dome-shaped cover extends outwardly and downwardly to a bottom edge, while covering the open grill. The mounting mechanism further extends downwardly over the vertical wall and is spaced from the mounting plate.

A primary objective of the present invention is to provide an attic vent having advantages not taught by the prior art.

Another objective is to provide an attic vent that includes a two-part construction that includes a base component and a dome-shaped cover, and wherein the base component includes a diverter extension wall that extends upwardly from an upper rim of the base component on a plane that is orthogonal to a mounting plate of the base component.

A further objective is to provide an attic vent does not require a third diverter component that was required by prior art attic vents.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an attic vent adapted to be mounted on a roof to cover a roof opening.

Figure 1:
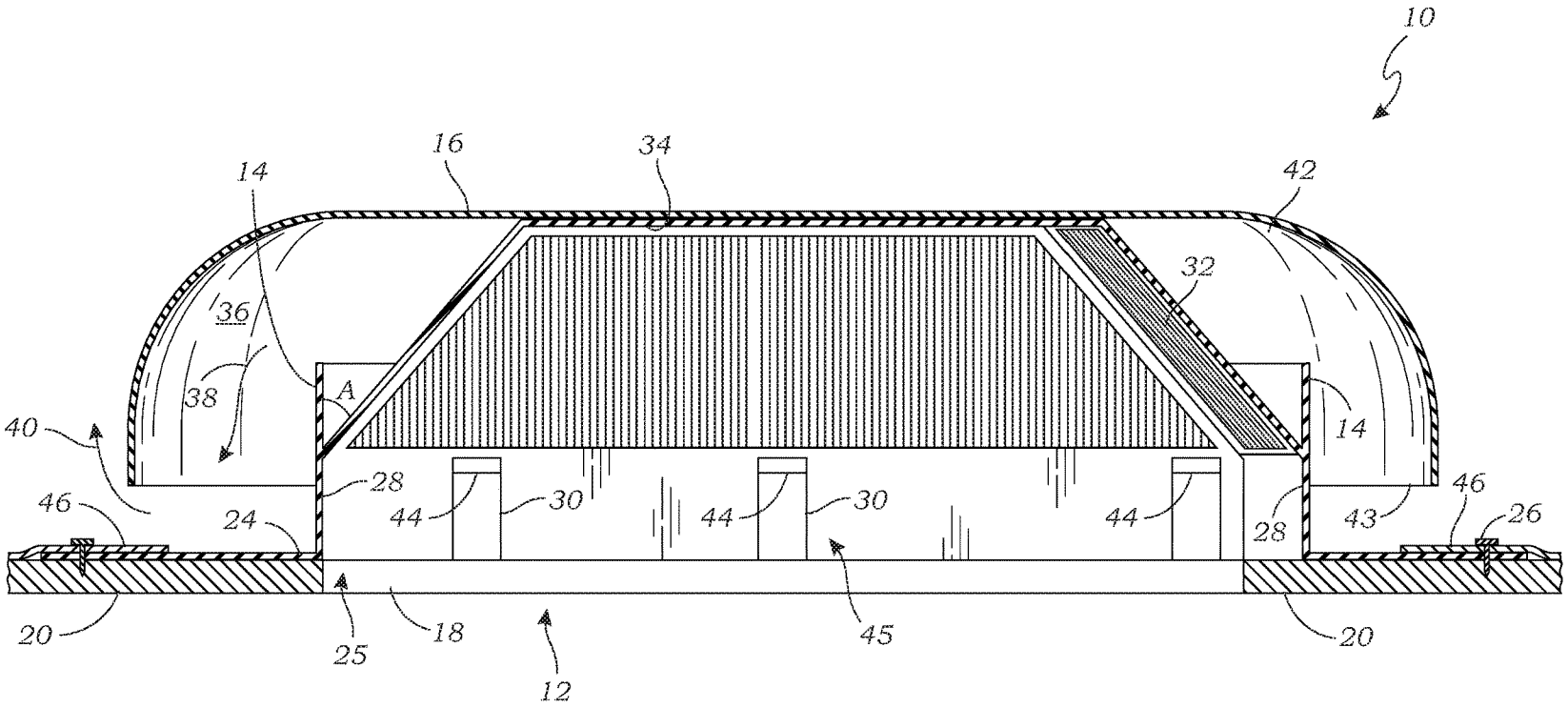
FIG. 1 is a side sectional view of an attic vent in one embodiment of the present invention.

FIG. 1 is a side sectional view of an attic vent 10 in one embodiment of the present invention. As shown in FIG. 1, the vent 10 includes a base component 12 that is mounted on a roof 20, and a dome-shaped cover 16 that covers the base component 12. The vent 10, once installed, fits in a water-tight seal over an opening 18 in a roof 20 such as, for example, over an attic or other similar enclosure which requires venting. If the vent 10 is installed on a sloping roof, such as is common on a residence, then the vent 10 includes a preferred orientation so that a particular portion of the vent 10 is directed up the slope of the roof. Once the bottom component 12 has been positioned on the roof 20 over the roof opening 18, roof shingles 46 or equivalent roofing materials may be installed over the mounting flange 24 to prevent water leakage. Mounting nails 26 may be used to secure the base component 12 and the roof shingles 46 to the roof 20.

Figure 2:
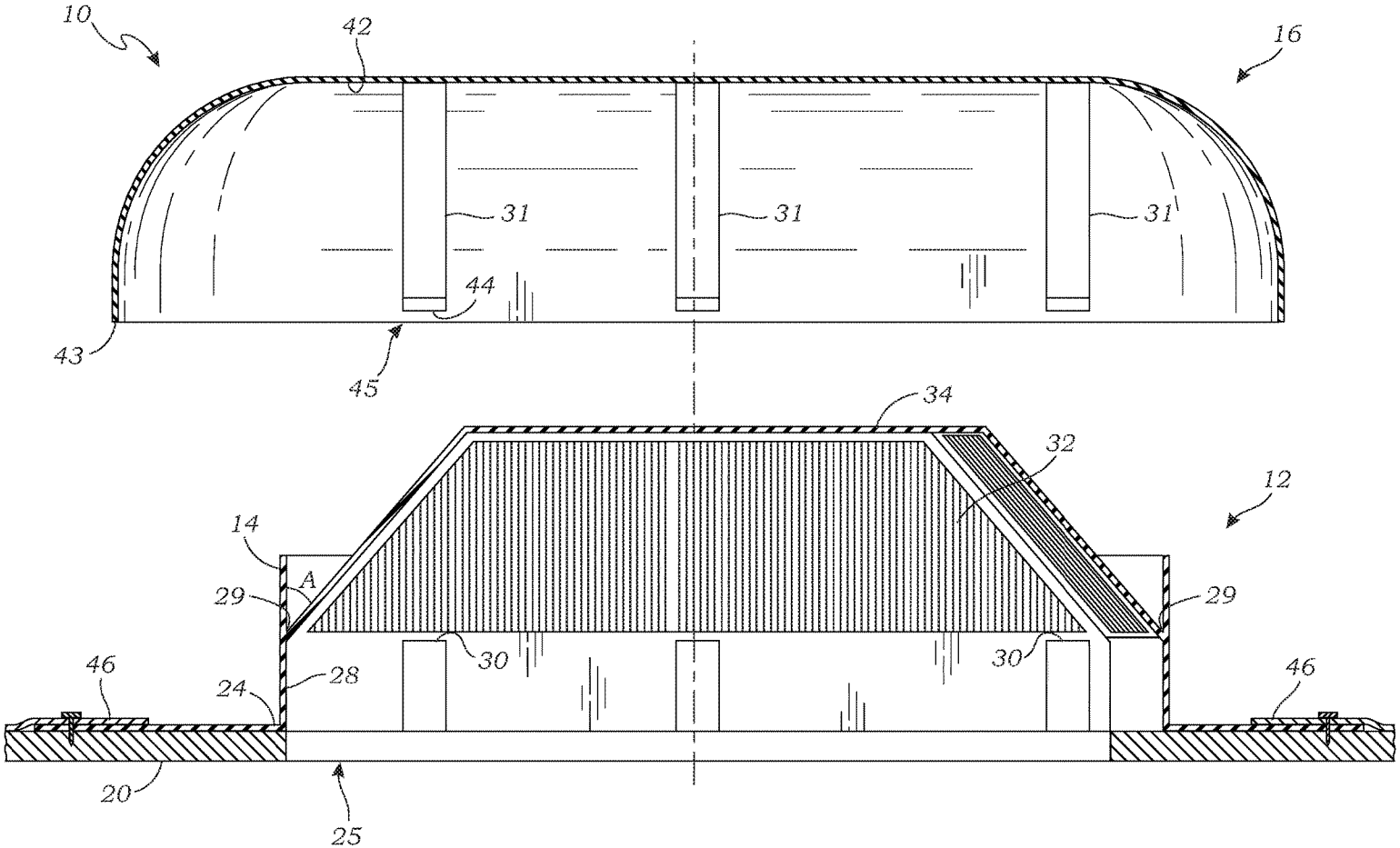
FIG. 2 is an exploded side sectional of the vent of FIG. 1, illustrating a base component having an integral diverter extension wall, and a dome cover that covers the base component.

FIG. 2 is an exploded side sectional view of the vent 10 of FIG. 1. As shown in FIGS. 1-2, the base component 12 includes a planar, flat mounting plate or flange 24. In this embodiment, the mounting plate 24 extends beyond the edge of the dome-shaped component 16 so that the mounting nails 26 may be more easily be installed. The mounting plate 24 includes a vent opening 25, and the mounting plate 24 is integrally formed with a vertical wall 28 which, in the preferred embodiment, is a generally annular wall that extends around the vent opening 25, as shown and described below.

Extending from the upper rim 29 of the vertical wall 28 is an open grill 32 in fluid communication with the roof opening 18. The open grill 32 is disposed on an angle A to the vertical wall 28. The vent opening 25 in the underside of the grill 32 is aligned with the roof opening 18 so that the open grill 32 is exposed directly to the space being vented, such as an attic. Preferably, the total cross-sectional area for air flow through the grill 32 and any other vents 10 installed on the building approximately equals the vent openings under the eaves of the building being vented for proper ventilation of the attic space and so that the pressure inside the attic is equal to outside pressure. The open grill 32 extends to a top portion 34 (e.g., edge) which may be in abutting contact with the underside of the dome-shaped component 16 once assembled (although this is not required). The top portion 34 may include just enough material to maintain structural robustness of the structure but does not need to contribute vent openings for ventilation of the space.

Critical to the present invention, as shown in FIGS. 1-2, the base component 12 further includes a diverter extension wall 14 that extends upwardly past the upper rim 29 of the vertical wall 28. In one embodiment, the diverter extension wall 14 extends about 1 inch past the upper rim 29. The vertical wall 28 and the diverter extension wall 14 are planar and disposed orthogonal to the plane of the mounting plate 24. The diverter extension wall 14 is integral to the base component 12, and forms a baffle structure between the open grill 32 and the dome-shaped cover 16.

The dome-shaped component 16 includes a body 42 that is shaped to cover the grill 32, and the body 42 extends outwardly and downwardly to a bottom edge 43 around which vented air passes. For purposes of this application, the term "dome-shaped component" is defined to include any form or shape of cover that extends outwardly and downwardly in such a manner as to exclude water from the base 12, as described herein.

A mounting mechanism 45 is provided for mounting the dome 16 on the base 12. In this embodiment, the mounting mechanism 45 includes first and second interlocking components 30 and 31. In this embodiment, the vertical wall 28 includes the first interlocking component 30, in this case a plurality of post-receiving openings. Each of the openings 30 may define a rectangular cylinder which receives the second interlocking component 31, in this case a plurality of posts of the dome-shaped component 16.

Air or gases which are to be vented from the enclosure below the vent 10 flow out through the opening 18, through the grill 32, over the diverter extension wall 14, and into volume 36 between the base component 12 and the dome-shaped component 16. The air then flows downward, as shown by arrow 38, around the edge 43 of the baffle component 14, and then out into the atmosphere as indicated by arrow 40. For any moisture such as rain or snow to get into the vented space, it must follow the reverse of the circuitous route just described for venting of gas, and entry of moisture is effectively prevented. The diverter extension wall 14 in particular prevents and inadvertent water entry during especially stormy and windy conditions.

Figure 3:
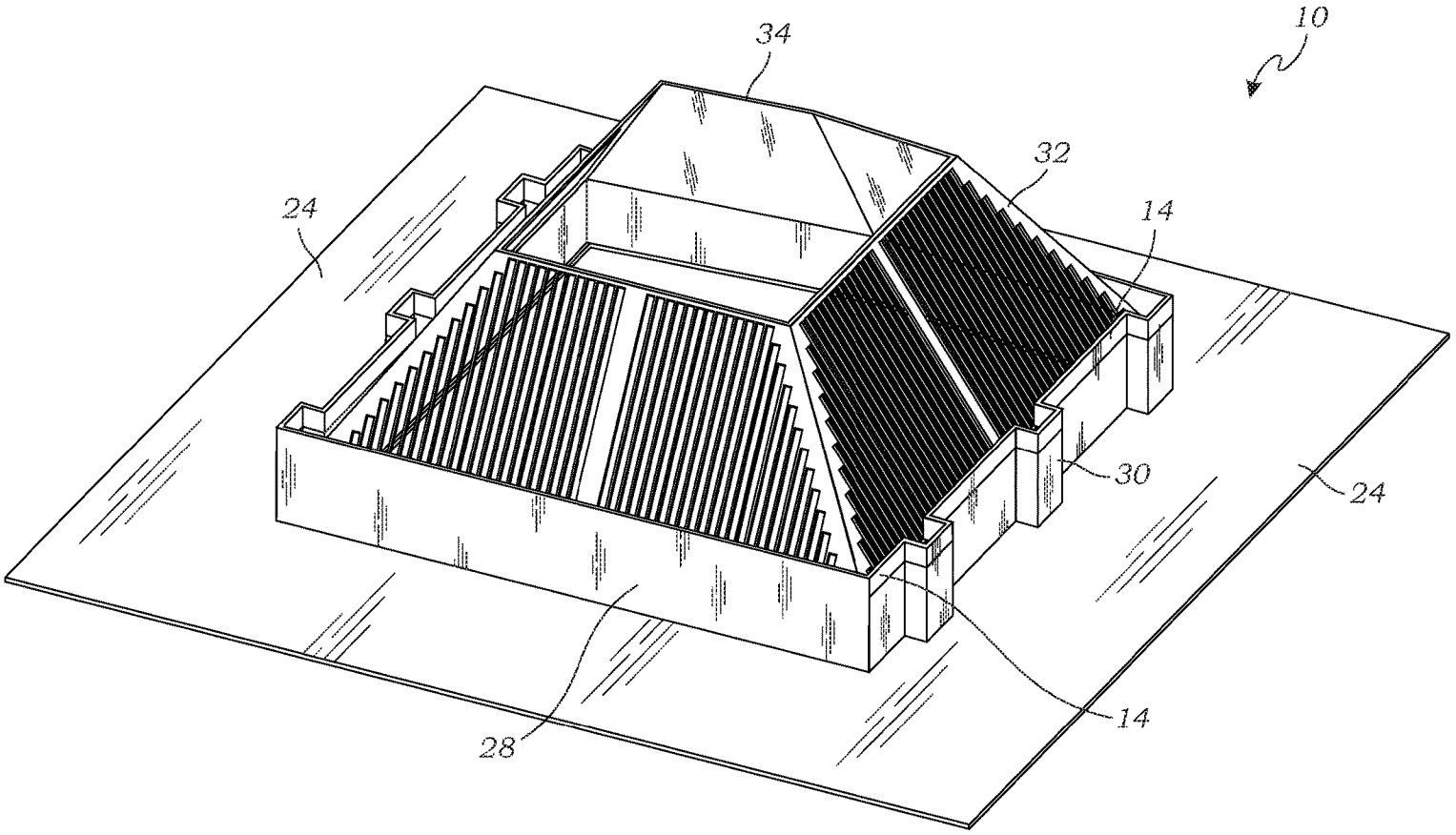
FIG. 3 is a perspective view of the base component of a first embodiment of the attic vent.
Figure 4:
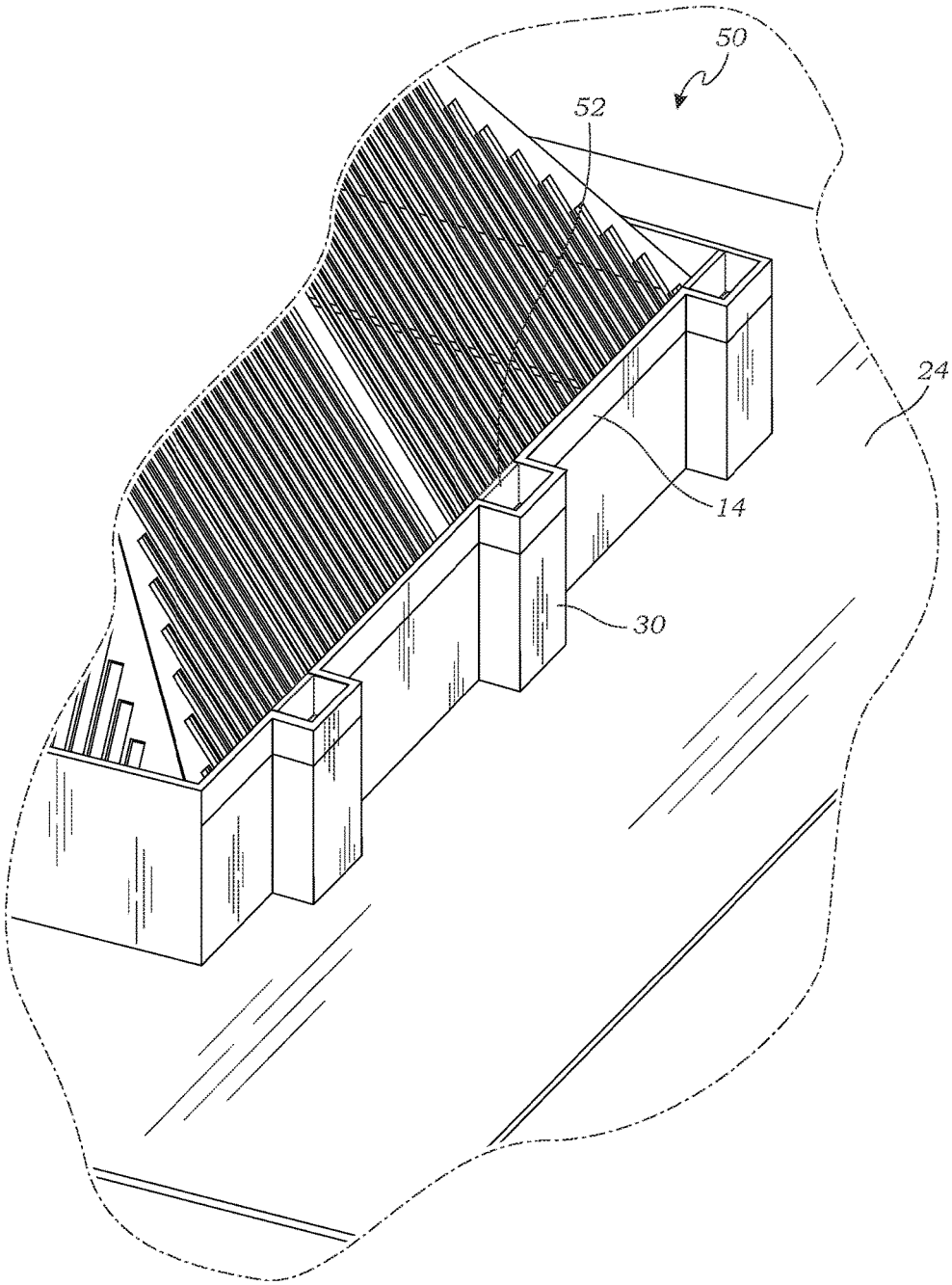
FIG. 4 is a perspective view of the base component of a second embodiment of the attic vent.

FIG. 3 is a perspective view of the base component 12 of a first embodiment of the attic vent 10. FIG. 3 illustrates the diverter extension wall 14 that extends upwardly from the upper rim 29 of the vertical wall 28. The diverter extension wall 14 of this embodiment extends around each of the post-receiving openings 30.

In another embodiment of the vent 50, the diverter extension wall 14 extends across each of the post-receiving openings 30, and includes fill walls 52 behind the openings 30. The post-receiving openings 30 may also extend upwardly as shown, or they could be shorter in other embodiments.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. An attic vent comprising a base component comprising:

a mounting plate having a vent opening;

a vertical wall surrounding the vent opening and extending upwardly from the mounting plate, the vertical wall extending to an upper rim;

a diverter extension wall that extends upwardly from the upper rim orthogonal to the mounting plate and around the entire perimeter of the vent opening;

an open grill extending upwardly from the upper rim at an inward angle from the diverter extension wall;

a dome-shaped cover shaped to cover the open grill, the dome-shaped cover being shaped to extend outwardly and downwardly to a bottom edge; and a mounting mechanism for mounting the dome-shaped cover onto and over the base component so that the bottom edge of the dome-shaped cover extends downwardly over the vertical wall and is spaced from the mounting plate.

2. The attic vent of claim 1, wherein the mounting mechanism includes a plurality of post-receiving openings in the base component, and a plurality of posts extending from the dome-shaped cover.

3. The attic vent of claim 2, wherein the diverter extension wall extends entirely around each of the post-receiving openings.

4. The attic vent of claim 2, wherein the diverter extension wall extends partially around each of the post-receiving openings.

5. The attic vent of claim 1, wherein the diverter extension wall extends about 1 inch from the upper rim of the vertical wall.

6. An attic vent comprising a base component comprising:

a mounting plate having a vent opening;

a vertical wall surrounding the vent opening and extending upwardly from the mounting plate, the vertical wall extending to an upper rim;

a diverter extension wall that extends upwardly about 1 inch from the upper rim orthogonal to the mounting plate and around the entire perimeter of the vent opening;

an open grill extending upwardly from the upper rim at an inward angle from the diverter extension wall;

a dome-shaped cover shaped to cover the open grill, the dome-shaped cover being shaped to extend outwardly and downwardly to a bottom edge; and a mounting mechanism for mounting the dome-shaped cover onto and over the base component so that the bottom edge of the dome-shaped cover extends downwardly over the vertical wall and is spaced from the mounting plate.

* * * * *